US005385682A

United States Patent [19]

Hutchings et al.

[11] Patent Number: 5,385,682

[45] Date of Patent: Jan. 31, 1995

[54] GREASE COMPOSITION

[75] Inventors: Timothy Hutchings, Wantage; Kathryn M. Pilgrem, Didcot, both of England

[73] Assignee: Exxon Research & Engineering Co., Florham Park, N.J.

[21] Appl. No.: 945,961

[22] PCT Filed: May 15, 1990

[86] PCT No.: PCT/GB91/00755

§ 371 Date: Dec. 24, 1993

§ 102(e) Date: Dec. 24, 1993

[87] PCT Pub. No.: WO91/18076

PCT Pub. Date: Nov. 28, 1991

[30] Foreign Application Priority Data

May 15, 1990 [GB] United Kingdom ..... 9010841

[51] Int. Cl.[6] ..... C10M 141/08

[52] U.S. Cl. ..... 252/18

[58] Field of Search ..... 252/18

[56] References Cited

U.S. PATENT DOCUMENTS

| | | | |
|---|---|---|---|
| 2,719,826 | 10/1955 | Hotten | 252/18 |
| 2,748,081 | 5/1956 | Peterson et al. | 252/28 |
| 3,090,750 | 5/1963 | Bergen et al. | 252/18 |
| 4,376,060 | 3/1983 | Stadler | 252/18 |
| 4,904,399 | 2/1990 | Waynick | 252/18 |
| 4,986,923 | 1/1991 | Waynick | 252/18 |
| 5,037,563 | 8/1991 | Pink et al. | 252/18 |

FOREIGN PATENT DOCUMENTS

| | | |
|---|---|---|
| 233757 | 8/1987 | European Pat. Off. . |
| 296362 | 12/1988 | European Pat. Off. . |
| 562552 | 7/1944 | United Kingdom . |
| 1599904 | 10/1981 | United Kingdom . |

*Primary Examiner*—John Niebling
*Assistant Examiner*—Edna Wong
*Attorney, Agent, or Firm*—James H. Takemoto

[57] ABSTRACT

A flame retardant grease composition comprising a lubricating base oil, a thickener selected from a simple or complex soap of lithium, calcium or sodium, and a flame retardant additive selected from an oxide, hydroxide, carbonate, bicarbonate, hydrogen carbonate or sulphate of an alkali metal or alkaline earth metal, for example calcium oxide, potassium carbonate, potassium hydrogen carbonate or potassium sulphate, or a mixture of two or more thereof.

2 Claims, No Drawings

GREASE COMPOSITION

This invention relates to grease compositions, more especially to grease compositions exhibiting flame retardant properties.

Greases containing metal soap thickeners, for example lithium, calcium or sodium soaps, are well known for industrial and other applications. With increasing health and safety standards, there is a need to improve the flame retardant properties of these greases.

Accordingly, the present invention provides a grease composition comprising:

(a) a lubricating base oil;

(b) a thickener selected from a lithium, calcium or sodium soap, or a mixture of two or more thereof: and (c) 2 to 15% by weight based on the total weight of the composition of an additive comprising an oxide, carbonate, bicarbonate, hydrogen carbonate or sulphate of an alkali metal or alkaline earth metal, or a mixture of two or more thereof.

It has been found that by including the inorganic additive (c), the flame retardant properties of the grease can be significantly enhanced.

The alkali or alkaline earth metal employed in the additive (c) (hereafter the "flame retardant additive" may be for example, lithium, sodium, potassium, magnesium or calcium. Calcium or potassium is preferred.

The salt of the flame retardant additive is preferably an oxide, carbonate, hydrogen carbonate, or sulphate. Examples of preferred compounds include calcium oxide, potassium carbonate, potassium hydrogen carbonate and potassium sulphate.

Whilst the flame retardant properties of the grease can be improved by the addition of a single flame retardant additive, it has been found surprisingly that when a mixture of two or more of the additives are employed, the additives act synergistically and the flame retardant properties achieved are greater than those using the same amount of each additive individually. Thus in a preferred embodiment of the invention the grease composition contains a mixture of two or more, preferably two, of the above flame retardant additives.

This bicomponent flame retardant additive mixture is preferably a combination of calcium and potassium compounds, for example calcium oxide and potassium carbonate, calcium oxide and potassium hydrogen carbonate, or calcium oxide and potassium sulphate.

The amount of the flame retardant additive incorporated in the grease depends upon, for example, the intended purpose of the grease as well as the composition of the grease. In general, the higher the proportion of the additive the greater the flame retardant properties. However, an excessive amount of additive can cause wear, and so generally from 2 to 15%, preferably from 4 to 11%, is used by weight based on the total weight of the composition. Where the flame retardant additive is a bicomponent mixture, it usually comprises 1 to 7% by weight of each component.

The thickener (b) employed in the grease composition according to the invention may be a simple or a complex soap of lithium, calcium or sodium, preferably lithium or calcium. Most preferably the thickener is either a simple lithium soap, a complex lithium soap or a simple or complex calcium soap. The amount of thickener is generally from 2 to 30%, more preferably 5 to 20%, by weight based on the total weight of the composition.

Where the soap is a simple lithium soap, it is preferred that the soap comprises a lithium soap of $C_{12}$ to $C_{24}$ hydroxy fatty acid more preferably a $C_{16}$ to $C_{20}$ hydroxy fatty acid. A particularly preferred hydroxy fatty acid is hydroxystearic acid, for example 9-hydroxy-, 10-hydroxy-, or 12-hydroxystearic acid, more preferably the latter. Ricinoleic acid, which is an unsaturated form of 12-hydroxystearic acid having a double bond in the 9–10 position, can also be used. Other suitable hydroxy fatty acids include 12-hydroxybehenic acid and 10-hydroxypalmitic acid.

Where the soap is a complex lithium soap, it preferably comprises a lithium soap as defined above for the simple lithium soap and at least one other lithium compound. This other lithium compound is advantageously either a lithium soap of a $C_2$ to $C_{12}$ aliphatic dicarboxylic acid or a lithium salt of boric acid, or a mixture of both.

Where the other lithium-containing compound is an aliphatic dicarboxylic acid, the proportion of dicarboxylic acid to hydroxy fatty acid employed is generally a weight ratio of between 0.05 and 1, usually between 0.1 and 0.8, parts dicarboxylic acid per part hydroxy fatty acid. The dicarboxylic acid is preferably a $C_4$ to $C_{12}$, more preferably $C_6$ to $C_{10}$, aliphatic dicarboxylic acid. Examples of suitable acids include oxalic, malonic, succinic, glutaric, adipic, suberic, pimelic, azelaic, dodecanedioic and sebacic acids. Azelaic and sebacic acids are especially-preferred.

Where the other lithium-containing compound is the lithium salt of boric acid, the proportion of hydroxy fatty acid to boric acid employed is generally a weight ratio of between 3 and 100 parts, usually between 5 and 80 parts, hydroxy fatty acid per part boric acid.

The lithium soap complex may also include a second hydroxycarboxylic acid. This generally has 3 to 14 carbon atoms and an —OH group not more than 6 carbon atoms away from the carboxyl group. This acid can be either an aliphatic acid such as lactic acid, 6-hydroxydecancic acid, 3-hydroxybutanoic acid, 1-hydroxycaproic acid, 4-hydroxybutanoic acid, 6-hydroxy-alpha-hydroxystearic acid, etc. or an aromatic acid such as parahydroxy-benzoic acid, salicylic acid, 2-hydroxy-4-hexylbenzoic acid, metahydroxybenzoic acid, 2,5-dihydroxybenzoic acid (gentisic acid); 2,6-dihydroxybenzoic acid (gamma resorcyclic acid); 4-hydroxy-4-methoxybenzoic acid, etc. or a hydroxyaromatic aliphatic acid such as orthohydroxphenyl, metahydroxyphenyl, or parahydroxyphenyl acetic acid. A cycloaliphatic hydroxy acid such as hydroxycyclopentyl carboxylic acid or hydroxynaphthenic acid could also be used. Particularly useful hydroxy acids are lactic acid, salicylic acid, and parahydroxybenzoic acid.

Alternatively a lower alkyl ester, usually, a $C_1$ to $C_4$ alkyl ester of the above second hydroxycarboxylic acid can be used instead of the free acid. This is especially beneficial when boric acid is employed as the ester aids dispersion of the insoluble salt. As example of a preferred ester is methyl salicylate. When a second hydroxycarboxylic acid is employed in the grease composition, the proportion is generally a weight ratio of 0.1 to 10 parts, usually 0.5 to 5 parts, second hydroxycarboxylic acid per part of the acid component of the said other lithium-containing compound, for example boric acid.

Where the soap is a calcium complex soap, it is preferably a soap as defined above for the lithium complex soap, substituting calcium for lithium, except that the other calcium compound may be a mono or dicarboxylic acid, or a calcium salt of boric acid, or a mixture thereof.

The lubricating base oil employed in the grease composition can be any of the conventionally used lubricating oils and is preferably a mineral oil, a synthetic oil or a blend of mineral and synthetic oils. In general these lubricating oils have a viscosity in the range of 15 to 220, preferably 30 to 150 cSt at 40° C., and a viscosity index in the range of 30 to 170, preferably 30 to 140. Mineral lubricating oil base stocks used in preparing the greases can be any conventionally refined base stocks derived from paraffinic, naphthenic and mixed base crudes. Synthetic lubricating oils that can be used include esters or dibasic acids, such as a di-2-ethylhexyl sebacate, esters of glycols such as $C_{13}$ oxo acid diester or tetraethylene glycol, or complex esters such as one formed from 1 mole of sebacic acid and 2 moles of tetraethylene glycol and 2 moles of 2-ethylhexanoic acid. Other synthetic oils that can be used include synthetic hydrocarbons such as alkyl benzenes, e.g. alkylate bottoms from the alkylation of benzene with tetrapropylene, or the polymers and copolymers of alpha olefins; silicone oils, e.g. ethyl phenyl polysiloxanes, methyl polysiloxanes, etc.; polyglycol oils, e.g. those obtained by condensing butyl alcohol with propylene oxide; carbonate esters, e.g. the product of reacting $C_8$ oxo alcohol with ethylcarbonate to form a half ester followed by reaction of the latter with tetraethylene glycol, etc. Other suitable synthetic oils include the polyphenyl ethers, e.g. those having from about 3 to 7 ether linkages and about 4 to 8 phenyl groups (see U.S. Pat. No. 3,424,678, column 3).

In addition to the components already mentioned, the grease may also contain other additives conventionally incorporated in greases, which include, but are not limited to, corrosion inhibitors, antiwear agents, pour point depressants, tackiness agents, extreme pressure agents, viscosity improvers, oxidation inhibitors, rust inhibitors, dyes and the like.

The grease composition according to the invention can be used in a variety of applications where flame retardants and fire resistance are important, for example in the lubrication of industrial and domestic machinery and appliances, in vessels and aircraft, and in public places where a fire would be a serious hazard, for example in enclosed spaces or areas catering for high volumes of people.

The invention will now be illustrated by the following examples.

EXAMPLE 1 (COMPARATIVE)

For comparative purposes, the flame retardant properties of a conventional simple lithium soap grease were tested. The grease comprised, by weight based on the total weight of the grease, 84.9% base oil and 10.6% of the lithium soap of 12-hydroxystearic acid, the balance consisting of an additive package of a sulphur-phosphorus extreme pressure agent, an amine-type antioxidant, a zinc naphthenate corrosion inhibitor and zinc dialkyl dithiophosphate.

The flame retardant properties of the grease were measured using the following test: 25 grams of the test grease were mixed with 0.5 gram cotton wool. 10 grams of this mixture was formed into a cone and the top of the cone pulled out to form a wick. The wick was ignited with a match, and the cumulative weight loss in grams and rate of weight loss in grams per minute of the grease sample measured at minute intervals. If the grease sample self-extinguished, the sample was reignited where possible by pulling out a further wick of the cotton wool/grease mixture and igniting this, and the test continued.

The results are given in Table 1. The grease ignited easily and continued to burn at an increasing rate. After 7 minutes over half the sample in weight had been lost, and the flame was deliberately extinguished.

EXAMPLE 2

A grease composition containing 10 wt % calcium oxide was formulated by mixing calcium oxide powder into the simple lithium soap grease having the composition as described in Example 1. The calcium oxide was incorporated into the grease using conventional laboratory scale mixing techniques. On a larger scale the calcium oxide can be incorporated using conventional grease mixing or milling techniques.

The flame retardant properties of the resulting grease composition were measured using the test procedure as set out in Example 1. The results are given in Table 1.

The results show that the grease containing calcium oxide has significantly improved flame retardant properties compared to the same grease containing no calcium oxide (Example 1). The calcium oxide-containing grease was difficult to ignite and after 7 minutes it self-

TABLE 1

| | Example No. | | | | | | | |
|---|---|---|---|---|---|---|---|---|
| | 1 (Comparative) | | 2 | | 3 | | 4 | |
| | Additive | | | | | | | |
| | None | | 10% CaO | | 7% $K_2CO_3$ | | 7.5% $KHCO_3$ | |
| Time (min) | Wt Loss (g) | Rate (g/min) | Wt Loss (g) | Rate (g/min) | Wt Loss (g) | Rate (g/min) | Wt Loss (g) | Rate (g/min) |
| 1 | .12 | .12 | .05* | .05 | .15 | .15 | .08 | .08 |
| 2 | .41 | .29 | .15 | .1 | .32 | .17 | .11 | .03 |
| 3 | .94 | .43 | .22 | .07 | .49 | .17 | .15 | .04 |
| 4 | 1.94 | 1.0 | .45 | .23 | .64 | .15 | .28 | .13 |
| 5 | 3.3 | 1.4 | .66 | .21 | .74 | .1 | .34* | .06 |
| 6 | 4.4 | 1.1 | .78 | .12 | .81* | .07 | .37 | .03 |
| 7 | 5.4 | 1.0 | .89* | .11 | .83 | .02 | .46 | .06 |
| 8 | PUT OUT | — | .91 | .02 | .95 | .12 | .48* | .05 |
| 9 | | | .95 | .04 | .96 | .01 | .53 | .05 |
| 10 | | | 1.1 | .2 | .97* | .01 | .62 | .09 |
| 11 | | | 1.5 | .4 | 1.0* | .03 | | |

*Indicates sample self-extinguished and had to be reignited.

extinguished and had to be reignited to continue the test. After 11 minutes only 1.5g of the sample had been lost.

EXAMPLE 3

A grease composition was formulated as described in Example 2 except that the calcium oxide was replaced with 7 wt % potassium carbonate.

The flame retardant properties of the resulting composition were measured using the test procedure as set out in Example 1. The results are given in Table 1.

The results show that the grease containing potassium carbonate has significantly improved flame retardant properties compared to the same grease containing no flame retardant additive (Example 1). The grease containing potassium carbonate was difficult to ignite and self-extinguished 3 times during the test. After 11 minutes only 1.0 g of the sample had been lost.

EXAMPLE 4

A grease composition was formulated as described in Example 2 except that the calcium oxide was replaced with 7.5 wt.% potassium hydrogen carbonate.

The flame retardant properties of the resulting composition were measured using the test procedure as set out in Example 1. The results are given in Table 1.

The results show that the grease containing potassium hydrogen carbonate has significantly improved flame retardant properties compared to the same grease containing no flame retardant additive (Example 1). The grease containing $KHCO_3$ was difficult to ignite and self-extinguished twice during the 10 minute test. At the end of the test only 0.62 g of the sample had been lost.

EXAMPLE 5

A grease composition containing 5 wt % calcium oxide and 5 wt % potassium carbonate was formulated by mixing these inorganic compounds, in powder form, into the simple lithium soap grease having the composition as described in Example 1. The inorganic compounds were mixed in using conventional laboratory scale techniques. On a larger scale, conventional grease mixing or milling techniques can be used. Preferably the potassium compound is milled with the grease at room temperature and then the calcium oxide is mixed in as a subsequent step.

The flame retardant properties of the resulting grease composition were measured using the test procedure as set out in Example 1. The results are given in Table 2.

The results show that the grease containing a mixture of calcium oxide and potassium carbonate as a flame retardant additive exhibits extremely good flame retardant properties. The grease was difficult to ignite and self-extinguished many times during the test. At all stages the weight loss was considerably better than that of the base grease containing no flame retardant additive (Example 1), and also better than that containing solely calcium oxide or potassium carbonate as the flame retardant additive (Examples 2 and 3 respectively).

TABLE 2

| | Example No. | | | | | | | |
|---|---|---|---|---|---|---|---|---|
| | 5 | | 6 | | 7 | | 8 | |
| | Additive | | | | | | | |
| | 5% CaO + 5% $K_2CO_3$ | | 5% CaO + 5% $KHCO_3$ | | 5% CaO + 5% $K_2SO_4$ | | 2% CaO + 4% $K_2SO_4$ | |
| Time (min) | Wt Loss (g) | Rate (g/min) | Wt Loss (g) | Rate (g/min) | Wt Loss (g) | Rate (g/min) | Wt Loss (g) | Rate (g/min) |
| 1 | .01* | .01 | .04* | .04 | .03 | .03 | .02 | .02 |
| 2 | .03* | .02 | .12 | .08 | .07 | .04 | .04 | .02 |
| 3 | .08* | .05 | .13 | .01 | .22 | .15 | .05 | .01 |
| 4 | .11* | .03 | .23 | .1 | .39 | .17 | .07 | .02 |
| 5 | .1 | NIL | .27* | .04 | .55 | .16 | .08* | .01 |
| 6 | .15* | .05 | .32 | .05 | .69 | .14 | .09 | .01 |
| 7 | .17* | .02 | .37* | .05 | .74* | .05 | .15 | .06 |
| 8 | .25* | .08 | .44 | .07 | .95 | .21 | .23 | .08 |
| 9 | .28* | .03 | .45* | .01 | 1.04 | .09 | .33 | .10 |
| 10 | .31 | .03 | .97* | .01 | 1.17 | .13 | .44 | .11 |
| 11 | .34* | .03 | .48* | .02 | 1.25 | .08 | .57* | .13 |
| 12 | | | | | 1.28* | .03 | .65 | .08 |

*Indicates sample self-extinguished and had to be reignited.

EXAMPLE 6

A grease composition was formulated as described in Example 4 except that the calcium oxide and potassium carbonate were replaced with a flame retardant additive mixture consisting of 5 wt % calcium oxide and 5 wt % potassium hydrogen carbonate.

The flame retardant properties of the resulting grease composition were measured using the test procedure as set out in Example 1. The results are given in Table 2.

The results show that the grease containing a mixture calcium oxide and potassium hydrogen carbonate as the flame retardant additive also exhibits very good flame retardant properties.

EXAMPLE 7

A grease composition was formulated as described in Example 4 except that the calcium oxide and potassium carbonate were replaced with 5 wt % calcium oxide and 5 wt % potassium sulphate.

The flame retardant properties of the resulting grease composition were measured using the test procedure as set out in Example 1. The results are given in Table 2.

The results show that this grease composition exhibits good flame retardant properties, although the weight loss is more that that for the other grease compositions containing 10 wt % of a bicomponent additive (Examples 4 and 5).

EXAMPLE 8

A grease composition was formulated as described in Example 4 except that the calcium oxide and potassium carbonate were replaced with 2 wt % calcium oxide and 4 wt % potassium sulphate.

The flame retardant properties of the resulting grease composition were measured using the test procedure as set out in Example 1. The results are given in Table 2.

The results show that the grease composition exhibits very good flame retardant properties, and that for the calcium oxide/potassium sulphate additive an amount of additive of 2 wt % CaO/4 wt % $KHCO_3$ is preferred to 5/5 wt % (Example 6).

EXAMPLE 9

A bicomponent flame retardant additive consisting of 4 wt % calcium oxide and 4 wt % potassium carbonate was mixed, using conventional laboratory scale mixing techniques, into a conventional simple lithium soap grease having the following formulation: 90.2 wt % base oil, 5.3 wt % lithium soap of 12-hydroxystearic acid, the balance consisting of an additive package of a sulphur-phosphorus extreme pressure agent, an amine-type antioxidant, a zinc naphthenate corrosion inhibitor and zinc dialkyl dithiophosphate.

The flame retardant properties of this resulting grease composition were measured using the test procedure as set out in Example 1. The results are given in Table 3.

TABLE 3

| Additive: 4% CaO + 4% $K_2CO_3$ | | |
|---|---|---|
| Time (min) | wt loss (g) | Rate (g/min) |
| 1 | .07 | .07 |
| 2 | .16 | .09 |
| 3 | .24 | .08 |
| 4 | .29 | .05 |

TABLE 3-continued

| Additive: 4% CaO + 4% $K_2CO_3$ | | |
|---|---|---|
| Time (min) | wt loss (g) | Rate (g/min) |
| 5 | .33* | .04 |
| 6 | .34 | .01 |
| 7 | .40 | .06 |
| 8 | .45* | .05 |
| 9 | .47 | .02 |
| 10 | .59 | .12 |
| 11 | .7* | .11 |
| 12 | .72 | .02 |

The results show that the grease composition exhibits very good flame retardant properties.

In EP 0,296,362 A2 there is disclosure of a lubricating grease, thickened by polyurea or a simple or complex calcium soap, for use in a drive joint of front-wheel drive vehicles. In order to improve the anti-wear properties of such a grease, a carbonate of an alkali metal or an alkaline earth metal is incorporated. Calcium carbonate is exemplified.

We claim:

1. A grease composition comprising:

(a) a lubricating base oil;

(b) a thickener selected from a lithium, calcium or sodium soap, or a mixture of two or more thereof; and (c) a flame retardant additive comprising a mixture containing 1 to 7% by weight, based on the grease composition, of calcium oxide and from 1 to 7% by weight, based on the grease composition, of a potassium compound selected from potassium carbonate, potassium hydrogen carbonate and potassium sulphate.

2. A grease composition according to claim 1 wherein the thickener (b) is a simple lithium soap.

* * * * *